US006691988B1

(12) United States Patent
Warfel et al.

(10) Patent No.: US 6,691,988 B1
(45) Date of Patent: Feb. 17, 2004

(54) TAMPER RESISTANT CARBURETOR MIXTURE NEEDLES

(75) Inventors: Paul A. Warfel, Texarkana, TX (US); Mike Wallace, Wake Village, TX (US); Rodney W. Tynes, Shreveport, LA (US); Tony Cochran, Texarkana, TX (US); Jeffrey S. Franke, Texarkana, TX (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 10/246,256

(22) Filed: Sep. 18, 2002

(51) Int. Cl.[7] ..... F02M 3/08

(52) U.S. Cl. ..... 261/71; 137/382.5; 261/DIG. 84; 261/DIG. 38; 411/408

(58) Field of Search ..... 261/71, DIG. 38, 261/DIG. 84; 411/408; 137/382, 382.5; 251/227, 291

(56) References Cited

U.S. PATENT DOCUMENTS

| | | | | | |
|---|---|---|---|---|---|
| 1,335,389 | A | * | 3/1920 | Rayfield | 261/41.1 |
| 2,711,883 | A | * | 6/1955 | Reeves | 261/41.5 |
| 2,728,564 | A | * | 12/1955 | Bracke | 261/69.2 |
| 3,453,655 | A | * | 7/1969 | Quinones et al. | 137/296 |
| 3,992,490 | A | * | 11/1976 | Preston | 261/41.5 |
| 4,052,490 | A | * | 10/1977 | Fedison | 261/34.2 |
| 4,097,561 | A | | 6/1978 | Seki et al. | 261/41.5 |
| 4,100,663 | A | * | 7/1978 | Crum | 29/426.1 |
| 4,120,918 | A | | 10/1978 | Codling | 261/71 X |
| 4,225,165 | A | | 9/1980 | Kesselman | 292/256.67 |
| 4,234,523 | A | | 11/1980 | Onuki et al. | 137/382 X |
| 4,242,290 | A | | 12/1980 | Handelsman et al. | 261/71 X |
| 4,269,246 | A | | 5/1981 | Larson et al. | 81/460 |
| 4,271,095 | A | | 6/1981 | Maeda | 137/382.5 X |
| 4,272,458 | A | | 6/1981 | Ruth et al. | 261/DIG. 38 |
| 4,273,730 | A | | 6/1981 | Byrnes, Jr. | 261/71 X |
| 4,283,353 | A | | 8/1981 | Miller | 261/71 X |
| 4,308,220 | A | | 12/1981 | Tateno | 137/382 X |
| 4,515,043 | A | | 5/1985 | Gray | 81/57.22 |
| 4,681,134 | A | | 7/1987 | Paris, Sr. | 137/385 |
| 5,094,265 | A | | 3/1992 | Jackson et al. | 137/383 |
| 5,236,634 | A | | 8/1993 | Hammett et al. | 261/71 |
| 5,252,261 | A | | 10/1993 | Gerhardy | 261/71 |
| 5,322,645 | A | | 6/1994 | Hammett et al. | 261/71 |
| 5,461,952 | A | | 10/1995 | Goss | 81/460 |
| 5,507,084 | A | | 4/1996 | Richter | 29/254 |
| 5,525,267 | A | | 6/1996 | Araki | 261/71 |
| 5,562,869 | A | * | 10/1996 | Drahos et al. | 261/71 |
| 5,603,869 | A | | 2/1997 | McNew et al. | 261/71 |
| 5,630,965 | A | | 5/1997 | Shaw et al. | 261/DIG. 38 |
| 5,635,113 | A | | 6/1997 | Walsh et al. | 261/DIG. 84 |
| 5,667,734 | A | | 9/1997 | Ohgane | 261/71 |

(List continued on next page.)

FOREIGN PATENT DOCUMENTS

| | | | |
|---|---|---|---|
| JP | 53-88422 | * | 8/1978 |

*Primary Examiner*—Richard L. Chiesa
(74) *Attorney, Agent, or Firm*—Pearne & Gordon LLP

(57) ABSTRACT

A tamper resistant mixture adjustment screw arrangement for a carburetor. The arrangement includes a carburetor body having at least one air/fuel adjustment screw threaded therein. The adjustment screw has a threaded shank and a head portion. The head portion is defined by a smooth top surface and an undulant, uneven side surface capable of being engaged and mated by an adjusting tool having a complementary undulant, uneven side surface capable of being engaged and mated by an adjusting tool having a complementary undulant, uneven surface for initially adjusting the air/fuel mixture in the carburetor. A blocking curb extends from the carburetor body to a level which at least substantially corresponds to a projecting extent of each adjustment screw and being closely spaced to the screw head to prevent the screw from being turned by commonly available tools, but to permit the screw to be adjusted by the adjusting tool.

12 Claims, 5 Drawing Sheets

U.S. PATENT DOCUMENTS

| | | | | |
|---|---|---|---|---|
| 5,707,561 | A | 1/1998 | Swanson | 261/71 |
| 5,753,148 | A | 5/1998 | King et al. | 261/71 |
| 5,772,927 | A | 6/1998 | Koizumi et al. | 261/71 X |
| 5,776,379 | A | 7/1998 | Bowles | 261/71 |
| 5,955,007 | A | 9/1999 | Koizumi et al. | 261/71 X |
| 5,961,896 | A | 10/1999 | Koizumi et al. | 261/71 X |
| 5,975,123 | A | 11/1999 | Underwood | 137/382 |
| 5,984,281 | A | 11/1999 | Hacker et al. | 261/71 |
| 6,003,845 | A | 12/1999 | Kus | 137/382 X |
| 6,074,147 | A | 6/2000 | Shu | 411/393 |
| 6,158,310 | A | 12/2000 | Goss et al. | 411/402 X |
| 6,234,458 | B1 | 5/2001 | Gerhardy | 261/71 |
| 6,302,383 | B1 | 10/2001 | Scarr | 261/71 |
| 6,302,384 | B1 | 10/2001 | Douyama | 261/71 |
| 6,387,250 | B1 | 5/2002 | Henkin et al. | 210/97 |
| 6,402,124 | B1 * | 6/2002 | Pattullo et al. | 261/71 |
| 2001/0026025 | A1 | 10/2001 | Nagata et al. | 261/71 |

* cited by examiner

FIG. 2
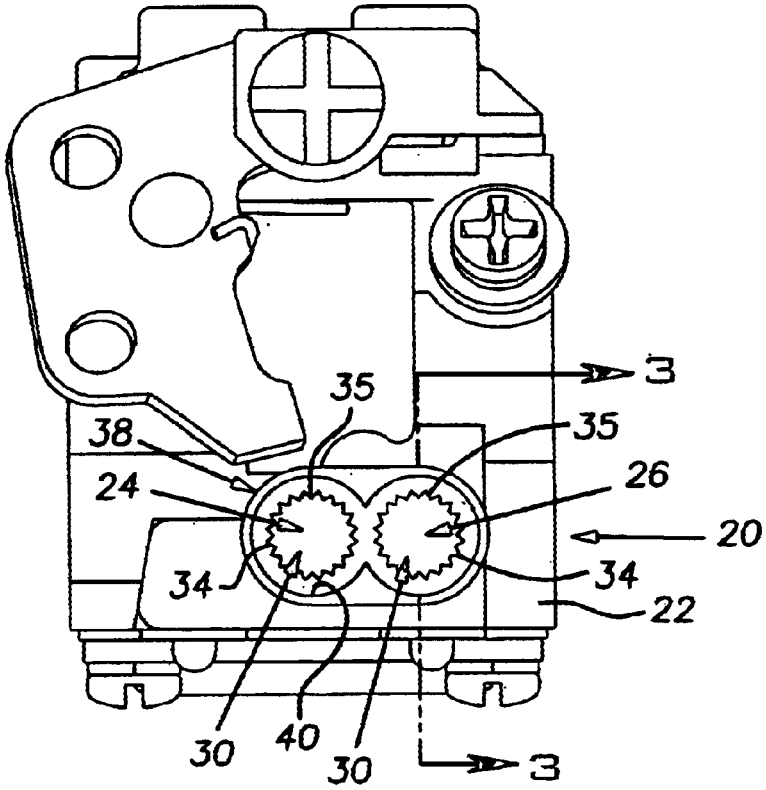
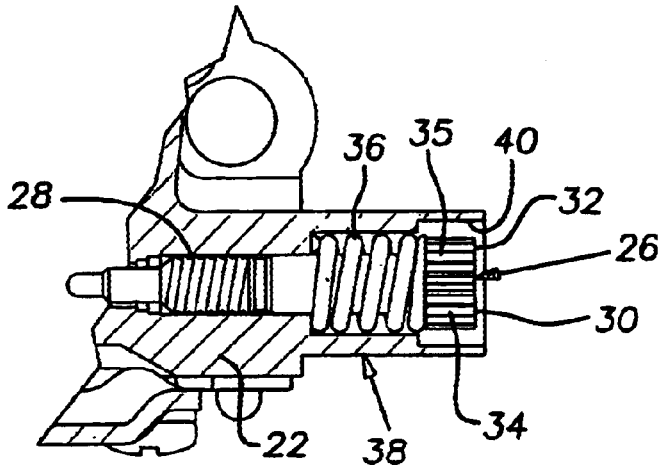
FIG. 3

TAMPER RESISTANT CARBURETOR MIXTURE NEEDLES

TECHNICAL FIELD OF THE INVENTION

This invention relates to carburetors and, more particularly, to a tamper resistant mixture adjustment screw arrangement for a carburetor.

BACKGROUND OF THE INVENTION

Environmental protection statutes and regulations are beginning to place limits on the combustion products of small power tools, such as gasoline powered lawn mowers, edgers, chain saws, and line trimmers. Such powered tools usually employ a diaphragm carburetor to control the air/fuel mixture fed to the two-cycle gasoline engine. Fuel is fed to an engine intake path by a fuel pump. The fuel pressure is regulated at a fixed pressure by a fuel pressure regulator. The fuel pressure regulator is equipped with a fuel chamber that stores fuel sent from the fuel pump. A diaphragm that forms one of the fuel chamber walls and a control valve that is interlocked to the motion of the diaphragm opens and closes the fuel chamber inlet. Thus, in any position, fuel is properly supplied to the engine. Fuel travels to the intake path from the fuel chamber through either a main fuel path or an idle fuel path.

A manual fuel mixture adjustment screw is provided for independently controlling the effective areas of the main and idle fuel paths. The adjustment screw includes a needle-shaped valve that can be advanced into or withdrawn from the fuel path.

The carburetor mixture adjustment screws are semi-fixed positionally to limit the amount of adjustment the operator can achieve for exhaust emissions requirements. The carburetor mixture needles can still be adjusted but the angular range is limited, usually by a cap or similar design preventing full rotational movement. Such an arrangement is disclosed and described in U.S. Pat. No. 5,603,869.

During the manufacturing of the end product the carburetor is adjusted to achieve peek performance and obtain acceptable exhaust emissions output. The 2-cycle engine is tested and the carburetor mixture needles are adjusted by the manufacturer to obtain a specific performance specification during the assembly process. After these performance objectives are achieved, the adjustor installs the limiter caps onto the mixture needles. Frequently, during the installation process of the limiter caps, the carburetor adjustment changes. When this occurs the final set point of the carburetor can either be unacceptable for performance or for exhaust emission standards.

Carburetor mixture needles on 2-cycle hand held products are very sensitive because the needle tip and jet diameters are very small. This is because the engine displacement size is small compared to those of larger engines used on automobiles, motorcycles, and the like. With the small engine displacement the fuel requirements is proportionally smaller which is what determines the effective jet size.

Depending on the 2-cycle engine design and the end product application, the carburetor can be equipped with either 2 mixture needles or a single mixture needle. With the two-mixture needle design both a low speed (idle) and a high speed (wide open throttle) fuel richness can be adjusted. On a single mixture needle design, only the high-speed mixture can be adjusted. This is acceptable on products that do not require strict performance at a low speed and can tolerate a fixed fuel flow rate.

The problem of carburetor adjustment changing when the limiter caps are installed are caused by several environmental factors. One factor is the amount of physical pressure required to install the cap onto the mixture needle. Several limiter cap designs rely on an interference fit between the mixture needle and the limiter cap to retain the cap on the needle. The force required to press the cap on the needle often moves the needle, and can even bend the needle.

Another factor that can affect the mixture needle is side pressure which tends to load the needle off center. The side load is created by the limiter cap design. Several carburetor designs rely on two mixture needles with close proximity to each other. On the two needle carburetor designs, the limiter caps have physical stops that are designed to contact the other mixture needle cap. This close proximity and tight design clearances of the two limiter caps can create a side load that will physically move the needles off their natural center to change the flow rate through the jet.

Further, another factor is the surrounding construction. Products like chain saws have housings and grommets designed with close proximity to the carburetor mixture needles. Grommets are used to keep dirt and debris out of the carburetor housing, which can cause damage to the product. These grommets can also apply a side load to the needles causing them to skew from their natural center.

Still further, another factor that can affect the mixture needle is vibration caused by the 2-cycle engine. This vibration creates a resonate vibration on the needle and will change the flow characteristics of the needle tip and jet nozzle. The length of the needle and additional mass of the limiter caps increases the vibration affect to the flow.

Another problem with the limiter cap application on carburetor mixture needles is the span of adjustment available. Government regulations has mandated that the limits of adjustment must be inspected and fall within the required emissions limits. The consistent reduction in allowable exhaust emissions has forced manufacturers to decrease the amount of allowable consumer adjustment to a point where any adjustment is impractical and provides no real benefit to the consumer.

These tight government regulations have also caused problems with the manufacturing of these products and the adjustment parameters are so stringent that the carburetor adjustment has become critical to the assembly operation. The strict adjustment specification sometimes requires several installations of limiter caps on one product before an acceptable set point is achieved, and the product is allowed to be shipped. This assembly bottleneck is a major cost factor in end product in terms of labor hours to build the final product.

A need exists for an arrangement which permits the carburetor mixture needles to be adjusted by the manufacturer or an authorized dealer to position the needle valve or valves at a position to obtain a specific performance specification during the assembly process or during reconditioning by the dealer, but prevents adjustment by the consumer.

BRIEF DESCRIPTION OF THE INVENTION

According to the invention, the carburetor mixture needles are designed so that the limiter cap can be omitted from the final design. This is achieved by a carburetor mixture needle design that cannot be turned by common hand tools, and is tamper resistant. The carburetor mixture adjustment performed by the manufacturer is considered fixed and non-adjustable by the consumer. This is not seen to be a problem since the strict emissions regulations has forced the manufacturers into carburetor designs that did not allow for any reasonable adjustment and therefore the consumer has no ability to correct the mixture setting.

The new tamper resistant mixture needle design according to this invention has a needle valve head that can be turned only with a special tool accessible by the manufacturer and authorized service dealers to perform carburetor adjustments. The mixture needle heads preferably have a special straight knurl pattern on the outside diameter of the head of the mixture needle that allows a special screwdriver tool to engage and turn the mixture needles for factory adjustment. The straight knurl design can be formed in different shapes and achieve the same affect. Another style would be splined or gear-like teeth.

There is no common tool commercially available for this style fastener or hardware. The tool according to this invention has an end formed with a mating profile that engages the straight knurl shape on the mixture needle heads. The teeth-like protrusions on the tool are staggered to ensure easy alignment. The number of teeth in the tool may be varied as long as they correspond with the mixture needle knurl spacing.

The advantage of the tamper resistant needle design is the stability of the adjustment achieved with this style mixture needle. The problems seen with the prior art design with respect to side loading, vibration, and changes after the limiter caps were installed are all minimized. This is mainly because no external forces are acting upon the mixture needles, and the needles do not have additional mass attached to the end of them.

Another advantage of this style needle design is in the form of assembly labor. The time to adjust the carburetor properly is reduced because of the mixture stability, and the setting does not require re-adjustment because the limiter cap installation may have changed the performance outside the acceptable parameters. The time to install the limiter caps on the mixture needles is also eliminated from the assembly operation.

There are also advantages from the emission regulations standpoint. Government emissions requirements are audited and monitored by the manufacturer for compliance. The time spent testing and auditing product is reduced because the non-adjustable style mixture needles. There is only one position (asset) and no limits, such as on limiter cap style, which still have some range of movement allowed.

In order to achieve the tamper resistant requirement as outlined by the two government agencies, California Air Resources Board (CARB), and Environmental Protection Agency (EPA), described above, the manufacturer has to prove that the design is tamper resistant. The needle head design is not enough if the consumer can still access and turn the mixture needles with, for example, pliers. So to prohibit use of other means of adjustment, the surrounding construction is designed to limit access to the mixture needles.

On gas chain saws a carburetor grommet can be used to prevent access to the mixture needles. The grommet has a small access hole that allows the adjustment tool to reach the needles for adjustment but is sized to prevent needle adjustment by other means. The grommet is designed so it cannot be removed from the chain saw without major disassembly of the product by means of a protruding wall that prevent removal from the mixture needles.

On string trimmers, leaf blowers, hedge trimmers and the like, the carburetor location may be more accessible than that on a chain saw, so the carburetor casting is provided with an additional protrusion that shields the mixture needles from being assessed and turned. This protrusion may be integral to the carburetor body casting, and therefore cannot be removed without permanent damage to the carburetor. Other means of construction are possible to achieve the same function as the integral wall. For example, a separate stamped steel cup formed in the same shape as the wall can be attached to the carburetor body.

According to one aspect of this invention, a blocking curb extends from the carburetor body to a level which at least substantially corresponds to a projecting extent of each adjustment screw. The blocking curb is closely spaced to the head of the adjusting screw to prevent the screw from being turned by commonly available tools, but to permit the screw to be adjusted by a special adjusting tool.

According to one aspect of the invention the blocking curb comprises a series of posts molded into the carburetor body. According to another aspect of the invention the blocking curb is integral with the carburetor body, surrounds the adjustment screw or screws, and has an inside arcuate surface which is closely spaced to each head for at least a major portion of the side surface of each head. According to a further aspect of the invention, the blocking curb comprises a drawn sleeve which surrounds the adjustment screw or screws and is captured by the adjustment screw spring.

According to a still further aspect of this invention, the blocking curb is a grommet which extends from the carburetor body and forms a chamber surrounding each adjusting screw head. A cylindrical access opening is provided for each screw head and each access opening is axially aligned with a screw head. The diameter of each opening is slightly larger than the diameter of each axially aligned screw head to prevent the screw from being turned by commonly available tools, but to permit the screw to be adjusted by a special adjusting tool adapted to engage a sidewall of the screw head.

BRIEF DESCRIPTION OF THE DRAWINGS

FIG. 2 is an elevational view of the arrangement shown in FIG. 1;

FIG. 3 is a cross-sectional view, the plane of the section being indicated by the line 3—3 in FIG. 2;

DETAILED DESCRIPTION OF THE INVENTION

Figure 1:
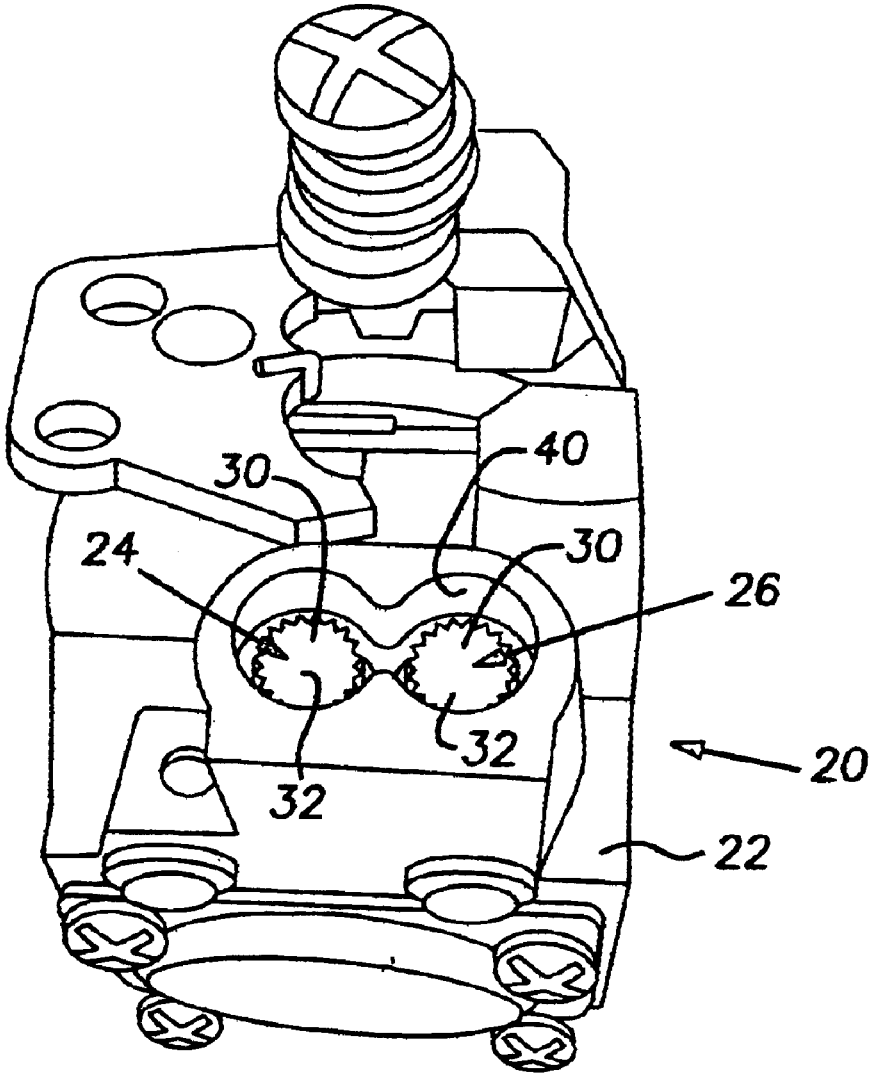
FIG. 1 is a perspective view of the carburetor having a tamper resistant screw arrangement according to one aspect of this invention.
Figure 3A:
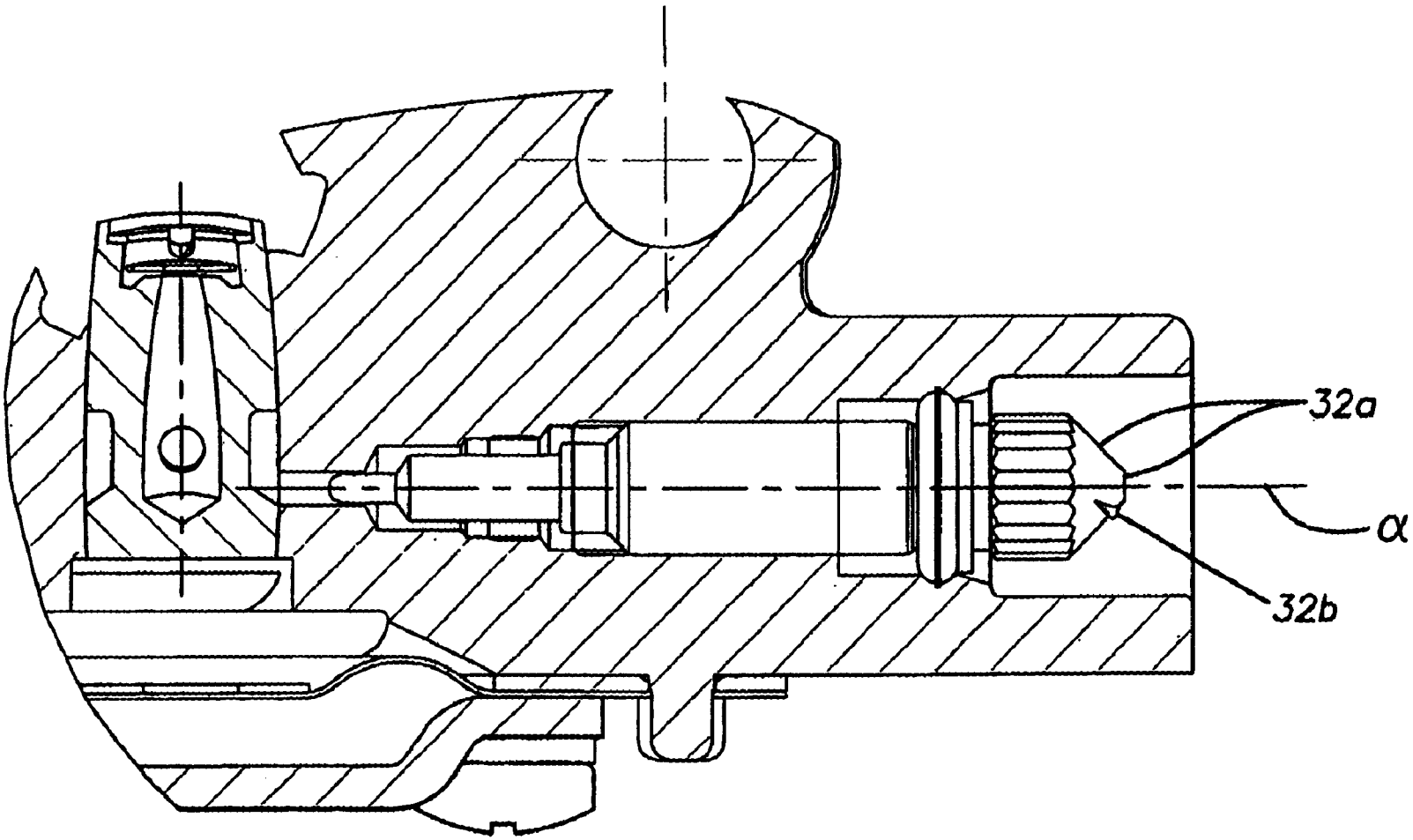
FIG. 3A is a cross-sectional view, similar to FIG. 3, but showing a screw having a top surface according to a further aspect of the invention.
Figure 4:
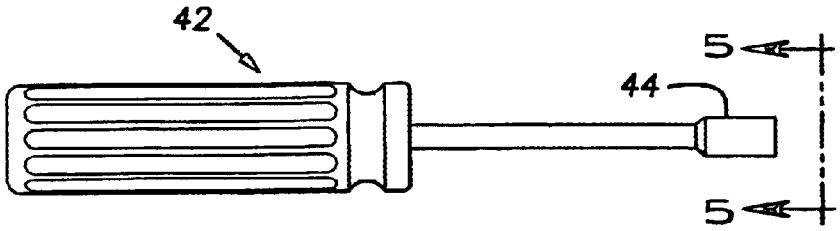
FIG. 4 is an adjusting tool for tamper resistant screws.

Referring now to the drawings and, particularly, to FIGS. 1–5D, there is illustrated an engine carburetor 20 having a carburetor body 22. Typically the carburetor 20 is used on a two-cycle small engine. Depending on the two-cycle engine design and the end product application, the carburetor can be equipped with either two mixture adjustment screws or needles or a single mixture adjustment screw or needle. With the two mixture needle design, both a low speed (idle) and a high speed (wide open throttle) fuel richness can be adjusted. On a single mixture needle design, only the high-speed mixture can be adjusted. This is acceptable on products that do not require strict performance at low speed and can tolerate a fixed flow rate.

In the illustrated embodiment the carburetor 20 has a low speed adjustment screw 24 and a high speed adjustment screw 26. Each screw 24 and 26 has a threaded shank 28 and a head portion 30. The head portion 30 is defined by a smooth top surface 32 and an undulant, uneven surface 34. The phrase "undulant, uneven surface" is intended to include a straight knurl shape 35, shown in FIGS. 2 and 3, a sinosoidal pattern 35*b*, shown in FIG. 5B, and a gear tooth or cog pattern 35*d*, shown in FIG. 5D. To prevent the adjustment screws 24 and 26 from being rotated due to vibration of the operating engine on which the carburetor is utilized, a compression spring 36 is received over the shanks of the screws and bears on the head portion 30 and the carburetor body 22. The phase "smooth top surface" is intended to include surfaces of revolution generated by rotating a straight, irregular, or curved line intersecting the longitudinal axis of the adjustment screw about the longitudinal axis. Such surfaces are characterized by the absence of tool engaging features such as a slot for engagement by a screw driver. An example of a smooth top surface is a surface of revolution generated by an irregular line 32*a* rotated about an axis $\alpha$ and is a truncated pyramid 32*b* shown in FIG. 3A.

A blocking curb 38 extend from the body 22 of the carburetor 20 to a level which least substantially corresponds to the projecting extent or the top of each head portion 30. In the embodiment illustrated in FIGS. 1–5D, the blocking curb 38 is molded as apart of the body 22 and, as may be seen most clearly in FIG. 3, extends beyond the top of each head portion 30. An internal wall 40 of the blocking curb 38 is closely spaced to the head portion 30 of each screw to prevent the head portion from being turned by commonly available tools, such as needle-nose pliers. It should be noted that the smooth top surface 32 of the head prevents the head from being turned by a screw driver.

Figure 5B:
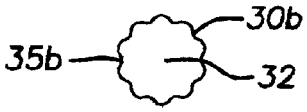
FIG. 5B is a top view of a screw head adapted to be engaged by the adjusting tool of FIG. 5A.
Figure 5D:
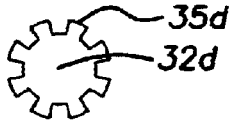
FIG. 5D is a top view of a screw head adapted to be engaged by the adjusting tool of FIG. 5C.
Figure 5:
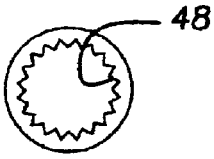
FIG. 5 is an end view of the adjusting tool shown in FIG. 4.

A special adjusting tool 42 is provided having an end socket 44. An inside surface 46 of the socket 44 has an undulant, uneven surface which, in FIG. 5, is a straight knurl surface 48. The surface 48 is adapted to fit over and conform to the straight knurl shape 35 of the head portion 30 as shown in FIGS. 2 and 3. The end socket 44 has an outside diameter which is dimensioned to fit within the internal wall 40 of the blocking curb 38.

Figure 5A:
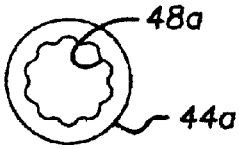
FIG. 5A is an end view of an adjusting tool according to a further aspect of this invention.

According to another aspect of this invention, and as is illustrated in FIG. 5A, an inside surface of a socket 44*a* has an undulant, uneven surface, which is a sinosoidal surface 48*a*. The surface 48*a* is adapted to fit over and conform to a sinosoidal shape 35*b* of a head portion 30*b*, as shown in FIG. 5B.

Figure 5C:
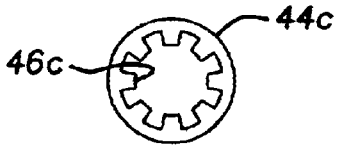
FIG. 5C is an end view of an adjusting tool according to a further aspect of this invention.

According to a further aspect of this invention, and as is illustrated in FIG. 5C, an inside surface of a socket 44*c* has a gear tooth or cog pattern 46*c*. The pattern 46*c* is adapted to fit over and conform to a gear or cog shape 35*d* of a head portion 30*d*, as is shown in FIG. 5D.

Figure 6A:
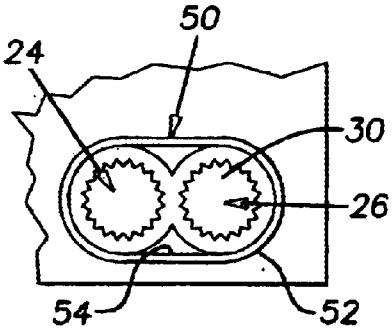
FIG. 6A is a fragmentary elevational view of the carburetor shown in FIG. 6, the plane of the view being indicated by the line 6A—6A in FIG. 6.
Figure 6:
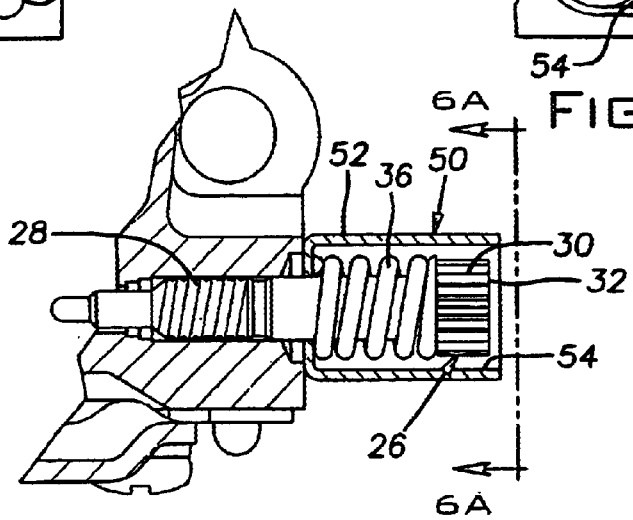
FIG. 6 is a fragmentary sectional view of a carburetor having a tamper resistant screw arrangement according to a further aspect of this invention.

Referring now to FIGS. 6 and 6A, a blocking curb 50, according to a further aspect of this invention, is illustrated. The blocking curb 50 comprises a drawn sleeve 52 which surrounds the adjustment screws 24 and 26 and is captured by the adjustment screw springs 36. An internal wall 54 of the blocking curb is closely spaced to the head portion 30 of each screw to prevent the head portion from being turned by commonly available tools, such as needle-nosed pliers. The end socket 44 of the adjusting tool 42 is dimensioned to fit within the internal wall 54 of the blocking curb 50.

Figure 7:
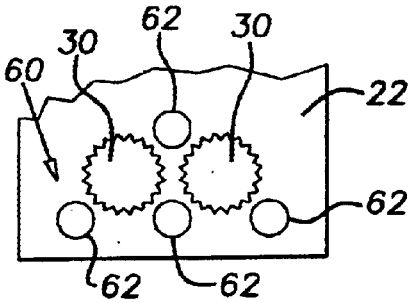
FIG. 7 is a fragmentary elevational view of a carburetor having a tamper resistant screw arrangement according to a further aspect of this invention.

According to a further aspect of this invention, and as is illustrated in FIG. 7, a blocking curb 60 comprises a series of posts 62. The posts 62 are molded as part of the body 22 and extend beyond the top of each head portion 30. Each post 62 is closely spaced to the head portion 30 of each screw to prevent the head portion from being turned by commonly available tools, such as needle-nosed pliers. The end socket 44 of the adjusting tool 42 is dimensioned to fit within the space between each post 62 and the head portion 30 of each screw.

Figure 8:
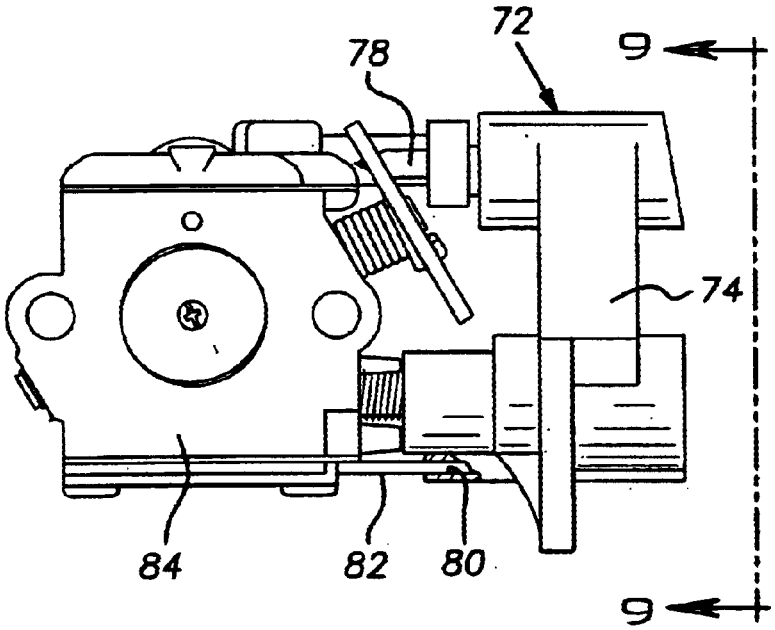
FIG. 8 is an elevational view of a carburetor having a tamper resistant screw arrangement according to a still further aspect of this invention.
Figure 9:
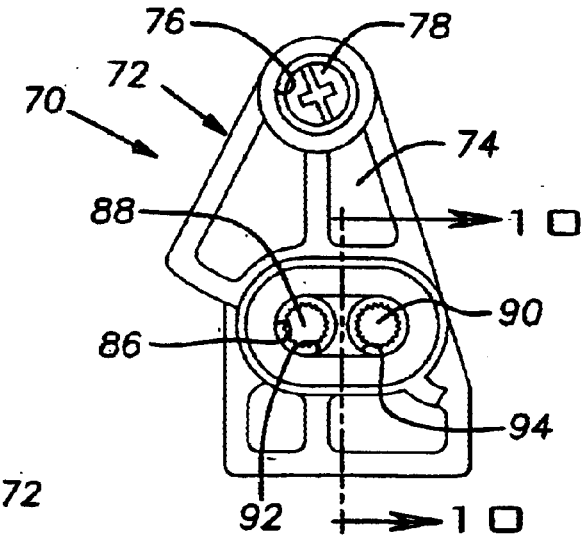
FIG. 9 is an end view of the carburetor shown in FIG. 8, the plane of the view being indicated by the line 9—9 in FIG. 8.
Figure 10:
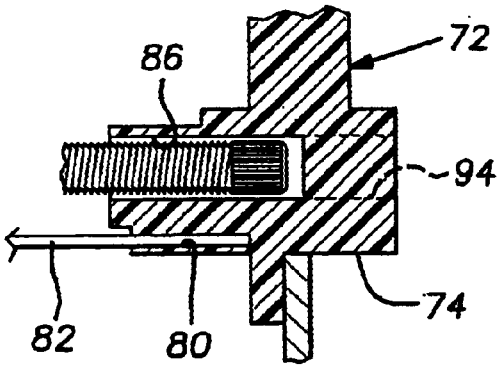
FIG. 10 is a fragmentary cross sectional view, the plane of the section being indicated by the line 9—9 in FIG. 9.

According to a still further aspect of the invention, and as is illustrated in FIGS. 8–10, a blocking curb 70 comprises a grommet 72. The grommet 72 is particularly useful on gasoline powered chain saws since it cannot be removed from the chain saw without major disassembly, as will become apparent. The grommet 72 may be molded from a hard plastic and comprises a body 74 having a passageway 76 which receives and provides access to a carburetor idle speed stop screw 78 and a pocket 80 which receives a blade extension 82 of a diaphragm cover plate 84. This mounting arrangement correctly positions the grommet 72 for mounting on a carburetor body 84. The grommet 72 includes a chamber 86 which surrounds mixture adjusting screws 88 and 90. Cylindrical access openings 92 and 94 lead to the chamber 86 and each access opening 92 and 94 is axially aligned with an adjusting screw head. The diameter of each opening 92 and 94 is slightly larger than the diameter of each axially aligned screw head to prevent the screw from being turned by commonly available tools, but to permit the screw to be adjusted by the adjusting tool 42 in the previously described manner.

The grommet 72 cannot be easily removed from the carburetor 84 since it is retained by an engine shroud wall (not shown).

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A tamper resistant mixture adjustment screw arrangement for a carburetor comprising:

a) a carburetor body having at least one adjustment screw threaded therein and projecting therefrom for adjusting the air/fuel mixture in the carburetor, said adjustment screw having a threaded shank and a head, said head being defined by a smooth top surface and an undulant, uneven side surface capable of being engaged and mated by an adjusting tool having a complimentary undulant, uneven surface for initially adjusting the air/fuel mixture in the carburetor; and b) a blocking curb extending from said carburetor body to a level which at least substantially corresponds to a projecting extent of each said adjustment screw and being closely spaced to said head to prevent the screw from being turned by commonly available tools, but to permit said screw to be adjusted by said adjusting tool.

2. A tamper resistant mixture adjustment screw arrangement according to claim 1, wherein said blocking curb is integral with said carburetor body and has an inside arcuate surface which is closely spaced to each head for at least a major portion of the side surface of each head.

3. A tamper resistant mixture adjustment screw arrangement according to claim 2, wherein said blocking curb extends beyond the projecting extent to each adjustment screw.

4. A tamper resistant mixture adjustment screw according to claim 1, wherein said blocking curb comprises a sleeve surrounding said adjustment screw and being retained by a spring surrounding said threaded shank.

5. A tamper resistant mixture adjustment screw arrangement according to claim 1, wherein said blocking curb comprises a series of posts extending from said carburetor body.

6. A tamper resistant mixture adjustment screw arrangement according to claim 1, wherein said undulant, uneven side surface is a straight knurl surface.

7. A tamper resistant mixture adjustment screw arrangement according to claim 1, wherein said undulant uneven side surface is a sinosoidal surface.

8. A tamper resistant mixture adjustment screw arrangement according to claim 1, wherein said undulant, uneven side surface is a gear or cog shape.

9. A tamper resistant mixture adjustment screw arrangement for a carburetor comprising:

a) a carburetor body having at least one adjustment screw threaded therein and projecting therefrom for adjusting the air-fuel mixture in the carburetor, said adjustment screw having a threaded shank and a head, said head being defined by a smooth top surface and an undulant, uneven side surface capable of being engaged and mated by an adjusting tool having a complimentary undulant, uneven surface for initially adjusting the air/fuel mixture in the carburetor; and b) a blocking curb extending from said carburetor body and forming a chamber surrounding each said head, a cylindrical access opening for each head, each said access opening being axially aligned with a head and having a diameter slightly larger than a diameter of its axially aligned head to prevent said screw from being turned by commonly available tools, but to permit said screw to be adjusted by said adjusting tool.

10. A tamper resistant mixture adjustment screw arrangement according to claim 9, wherein said undulant, uneven side surface is a straight knurl surface.

11. A tamper resistant mixture adjustment screw arrangement according to claim 9, wherein said undulant uneven side surface is a sinosoidal surface.

12. A tamper resistant mixture adjustment screw arrangement according to claim 9, wherein said undulant, uneven side surface is a gear or cog shape.

* * * * *